US011203872B2

(12) United States Patent
Hilgendorf et al.

(10) Patent No.: US 11,203,872 B2
(45) Date of Patent: Dec. 21, 2021

(54) ROLLING ACCESS STEP

(71) Applicant: Dennis J. Hilgendorf, Stoughton, WI (US)

(72) Inventors: Dennis J. Hilgendorf, Stoughton, WI (US); David A. Rynes, Stoughton, WI (US)

(73) Assignee: Dennis J. Hilgendorf, Stoughton, WI (US)

( * ) Notice: Subject to any disclaimer, the term of this patent is extended or adjusted under 35 U.S.C. 154(b) by 0 days.

(21) Appl. No.: 16/802,081

(22) Filed: Feb. 26, 2020

(65) Prior Publication Data

US 2021/0262238 A1 Aug. 26, 2021

(51) Int. Cl.
*E04F 11/06* (2006.01)
*E04G 3/28* (2006.01)

(52) U.S. Cl.
CPC ..... *E04F 11/062* (2013.01); *E04G 2003/283* (2013.01)

(58) Field of Classification Search
CPC ..... E06C 1/397; E06C 1/393; E06C 1/383; E06C 1/3835; E06C 9/12; E04F 11/04; E04F 11/06; E04F 11/062; E04F 11/064; E04F 11/066
USPC ..... 52/183, 184, 188; 182/127, 36, 37, 38, 182/39, 84, 85, 86, 156, 159, 160, 162
See application file for complete search history.

(56) References Cited

U.S. PATENT DOCUMENTS 469,751 A * 3/1892 Capacciolo ..... E06C 9/12 182/38
476,564 A * 6/1892 Sincennes ..... E06C 9/12 182/38
506,903 A * 10/1893 Potts ..... E06C 1/397 182/17

(Continued)

FOREIGN PATENT DOCUMENTS

EP 3192940 A1 7/2017
KR 20060116670 A 11/2006
KR 20180070001 A 6/2018

OTHER PUBLICATIONS

BCompact Hybrid Stairs, https://good-design.org/projects/bcompact-hybrid-stairs/, downloaded Oct. 14, 2019.

(Continued)

*Primary Examiner* — Kyle J. Walraed-Sullivan
(74) *Attorney, Agent, or Firm* — Stiennon & Stiennon

(57) ABSTRACT

A traveling step structure is mounted to a warehouse rack to allow convenient access to elevated shelves without blocking shelving corridors. A rack track is mounted to a rack between vertical rack members and a support track is fixed to the surface which supports the rack. The traveling step structure has a first frame mounted with followers to the rack track, and a second frame positioned outwardly from the first frame, and connected to the first frame for movement from a retracted position to an extended position. A plurality of steps extend between the first frame and the second frame and are pivotably mounted to both frames. When a user desires to access an elevated rack shelf, the second frame is pulled outwardly and downwardly to bring the steps into a horizontal position. A damper assembly is mounted between the first frame and a step to cushion extension.

21 Claims, 5 Drawing Sheets

(56) References Cited

U.S. PATENT DOCUMENTS 536,232 A * 3/1895 Davison ..... E06C 1/397 182/15
553,108 A * 1/1896 Sincennes ..... A47B 83/02 297/142
726,708 A * 4/1903 Compte ..... E04G 3/34 182/12
740,382 A * 9/1903 Osestreicher ..... E06C 1/397 182/13
907,401 A * 12/1908 Prouty ..... E06C 9/12 182/39
3,340,960 A * 9/1967 Wilson ..... E06C 1/345 182/39
3,391,757 A * 7/1968 Duke ..... E04G 3/34 182/17
4,232,759 A * 11/1980 Jacobs ..... E04G 1/20 182/117
4,396,092 A * 8/1983 Thompson ..... E04G 1/24 182/38
5,148,889 A * 9/1992 Fenwick ..... B65G 1/0492 182/115
5,480,002 A * 1/1996 Kerr ..... E06C 9/12 182/115
5,505,476 A * 4/1996 Maccabee ..... B60R 3/02 280/163
5,624,127 A * 4/1997 Arreola ..... B60R 3/02 182/127
5,653,307 A * 8/1997 Kerr ..... E06C 9/12 182/15
5,671,823 A * 9/1997 Oakes ..... E04G 1/34 182/36
5,941,342 A * 8/1999 Lee ..... B60R 3/02 182/95
5,957,237 A * 9/1999 Tigner ..... B60R 3/02 182/127
6,230,841 B1 * 5/2001 Valore ..... E06C 1/39 182/15
6,457,559 B1 * 10/2002 Schlueter ..... E06C 1/383 182/159
6,536,558 B2 * 3/2003 Price ..... E06C 1/20 182/160
6,619,427 B1 * 9/2003 Kerr ..... A47B 96/00 182/36
6,951,265 B2 * 10/2005 Frame ..... B64F 1/315 182/127
6,981,572 B2 * 1/2006 Hedley ..... E06C 9/08 182/95
7,857,337 B2 * 12/2010 Ferguson ..... B60R 3/02 280/166
8,251,178 B2 * 8/2012 Krobot ..... B60R 3/02 182/88
8,302,734 B2 * 11/2012 Krock ..... E06C 1/39 182/84
8,376,084 B2 * 2/2013 Castagno ..... E06C 5/04 182/84
10,532,827 B2 * 1/2020 Springer ..... E06C 5/06
2012/0312634 A1 * 12/2012 Morikawa ..... B65G 1/02 182/39
2013/0081902 A1 * 4/2013 Liao ..... E04G 23/002 182/20
2013/0193667 A1 * 8/2013 Ellement ..... E06C 5/28 280/166
2014/0097039 A1 * 4/2014 Kerr ..... E06C 7/183 182/39
2018/0094484 A1 * 4/2018 Frame ..... E06C 7/182
2020/0102094 A1 * 4/2020 Springer ..... E04G 27/00
2020/0300038 A1 * 9/2020 Pinnock ..... E06C 1/383
2020/0362633 A1 * 11/2020 Liu ..... E06C 7/188
2020/0362634 A1 * 11/2020 Liu ..... E06C 9/06

OTHER PUBLICATIONS

BCompact Hybrid Stairs, https://www.bcompact.com/designer/all/bcompact-stairs/, downloaded Oct. 14, 2019.

"Access Steps", Engineered Solutions, https://www.engineeredsolutionsdirect.com/industrial-equipment/steps-ladders/access-steps.html, downloaded Feb. 19, 2020.

* cited by examiner

ROLLING ACCESS STEP

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to rack storage of goods, and more particularly to arrangements to facilitate access to elevated stored goods.

Warehouse storage of goods provides a compact and efficient arrangement for ready access to a multiplicity of items. Although heavy and palletized items may be accessed with forklifts or motorized equipment, smaller items are still accessed directly by users. Yet, even moderately heavy items can cause worker stress if they must be accessed from an elevated position. Ladders permit workers to reach an elevated position, but the narrow steps and steep pitch of conventional ladders hamper effective and efficient access. Rolling warehouse access steps are known, but these devices can obstruct narrow warehouse corridors, impeding ready access for multiple workers.

What is needed is an arrangement which provides convenient access to elevated goods while avoiding undue corridor blockage.

SUMMARY OF THE INVENTION

The traveling step structure of the invention is mounted to a warehouse rack to allow convenient access to elevated shelves without blocking shelving corridors. A horizontally extending rack track is mounted to a rack between vertical rack members and a support track is fixed to the horizontal surface which supports the rack. The traveling step structure has a first frame mounted with followers to the rack track and to the support track. A second frame is positioned outwardly from the first frame and connected to the first frame for movement from a retracted position to an extended position. A plurality of steps extend between the first frame and the second frame and are pivotably mounted to both frames. When a user desires to access an elevated rack shelf, the second frame is pulled outwardly and downwardly to bring the steps into a horizontal position. A damper assembly is mounted between the first frame and a step to cushion extension, and to aid return of the structure to the retracted position. The step structure may be retained in the retracted position by a mechanical or magnetic latch.

It is an object of the invention to provide a device which offers convenient and effective access to goods on elevated rack shelves.

It is another object of the invention to provide steps which alternatively permit access to elevated rack shelves but which can be readily retracted to provide clearance within narrow corridors.

It is a further object of the present invention to provide steps which are conveniently moved along the length of a warehouse rack.

It is a still further object of the present invention to provide a warehouse step assembly which provides assistance to the user in collapsing the device.

It is yet another object of the present invention to provide a movable collapsible step assembly which can be attached to existing warehouse racks with some variation in the level of a rack-mounted track.

Further objects, features and advantages of the invention will be apparent from the following detailed description when taken in conjunction with the accompanying drawings.

DESCRIPTION OF THE PREFERRED EMBODIMENTS

Figure 1:
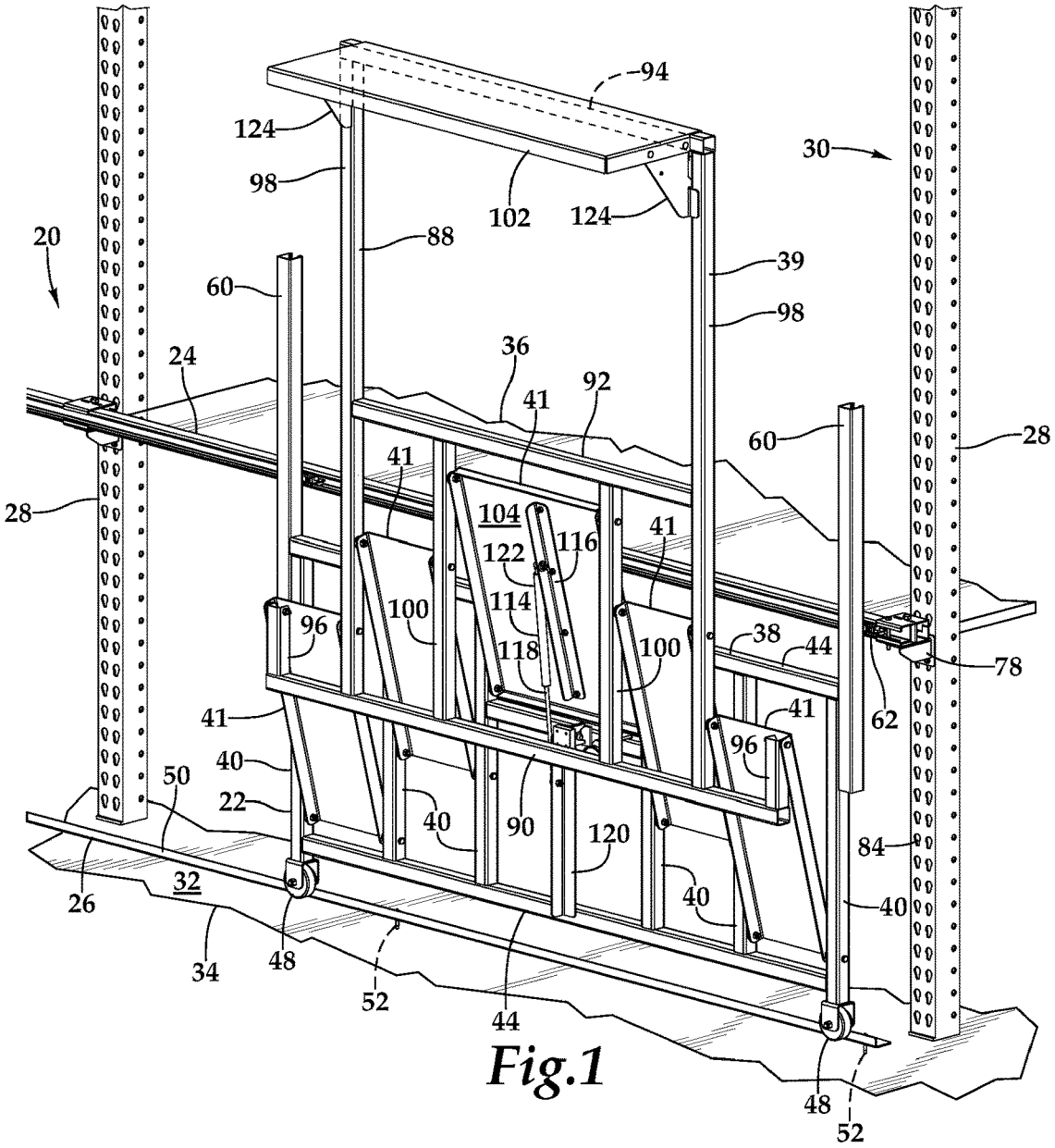
FIG. 1 is an isometric view of the rolling access step assembly of this invention shown in a retracted position.
Figure 2:
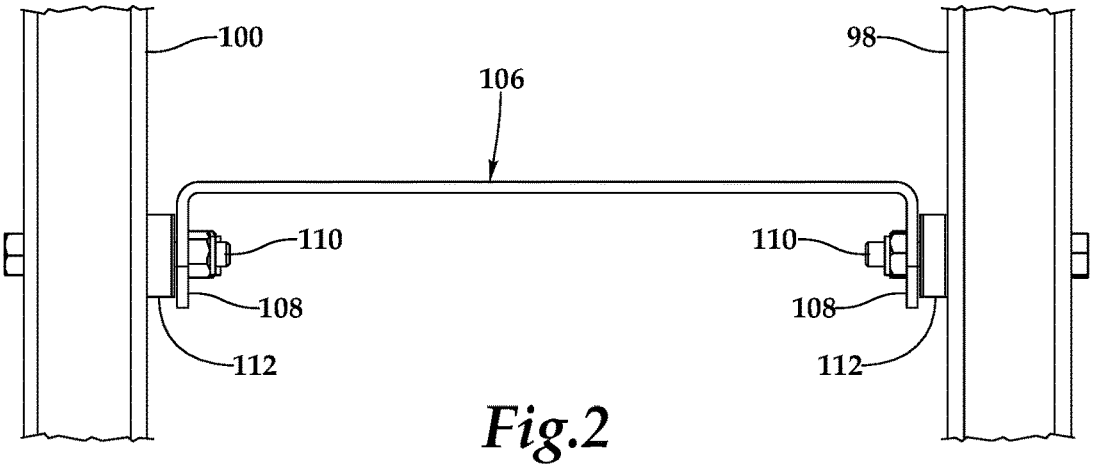
FIG. 2 is a fragmentary cross-sectional view of the rolling access step assembly of FIG. 3, showing the mounting of a step to a frame.
Figure 3:
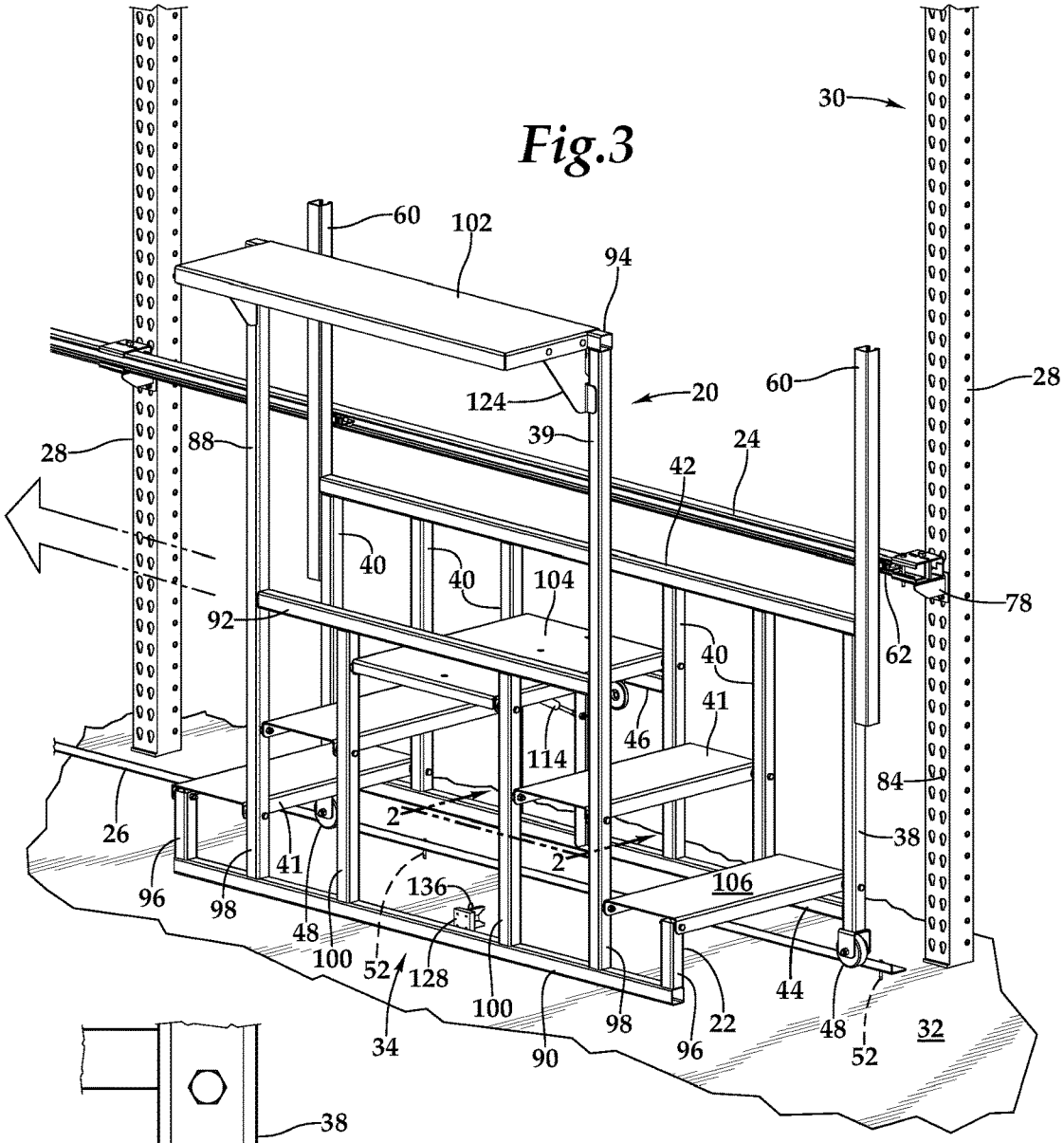
FIG. 3 is an isometric view of the rolling access step assembly of FIG. 1 shown in an extended position for use in accessing the contents of a storage rack.

Referring more particularly to FIGS. 1-9, wherein like numbers refer to similar parts, a rolling access step assembly 20 is shown in a retracted configuration in FIG. 1. The rolling access step assembly 20 has a traveling step structure 22 connected for horizontal movement along a rack track 24 and a support surface track 26. The rack track 24 is mounted between the vertical members 28 of a storage rack 30. The support surface track 26 is fixed to the surface 32 which supports the rack. The traveling step structure 22 is thus movable horizontally along the length of the rack, and is collapsible into a retracted position in which the structure does not block the warehouse corridor 34 in front of the rack, as shown in FIG. 1, while being expandable into an extended position as shown in FIG. 3 for convenient access to goods stored on elevated shelves 36 of the rack 30.

Figure 7:
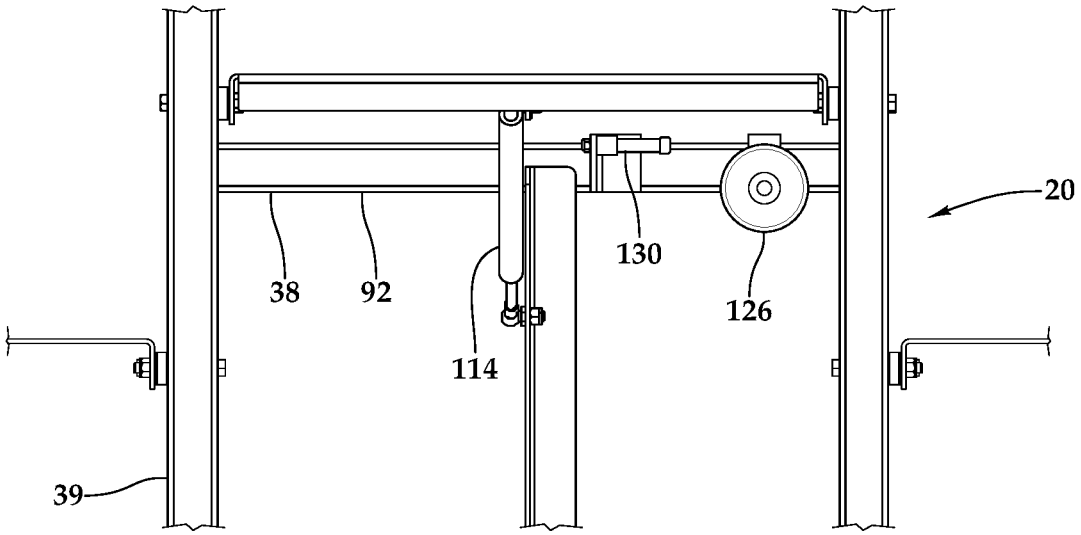
FIG. 7 is a fragmentary front elevational view of the extended rolling access step of FIG. 5 taken at view line 7-7.

As shown in FIG. 3, the traveling step structure 22 has a first frame 38 joined to a second frame 39 by metal steps 41, 104. The first frame 38 is comprised of welded square tubular steel members including six vertical members 40 which extend between an upper member 42 and a lower member 44, and a central cross member 46 which extends between the two centermost vertical members, as shown in FIG. 7.

Figure 4:
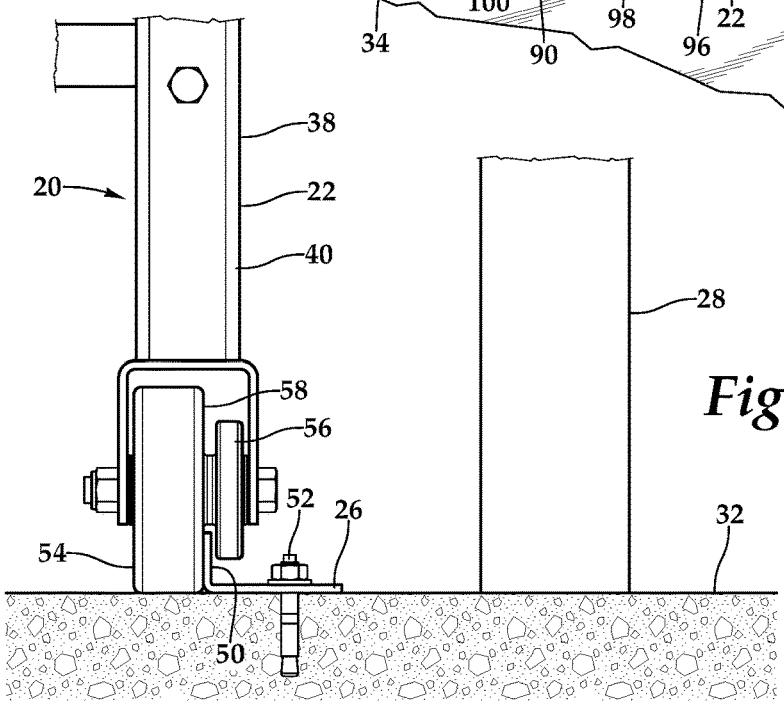
FIG. 4 is a fragmentary end view of a grooved wheel mounted to the first frame which serves a follower within a track which is fixed to a support surface.

Two rollers 48 are mounted one to each of the outermost first frame vertical members 40. As shown in FIG. 4, the rollers 48 serve as follower members which engage with an upwardly protruding flange 50 of the support surface track 26. The support surface track 26 is secured by fasteners 52 to the support surface 32, which may be, for example, a poured concrete slab. Each roller 48 has a large diameter cylinder 54 which engages the support surface and rolls thereover, and a small diameter cylinder 56 which extends from the large diameter cylinder with a groove 58 therebetween. The small diameter cylinder 56 does not reach to the support surface, but the flange 50 of the support surface track 26 extends into the groove 58 and is retained between the large and small cylinders 54, 56. The engagement of the rollers 48 with the support surface track 26 constrains the first frame to travel along a path which is parallel to the rack 30.

Figure 9:
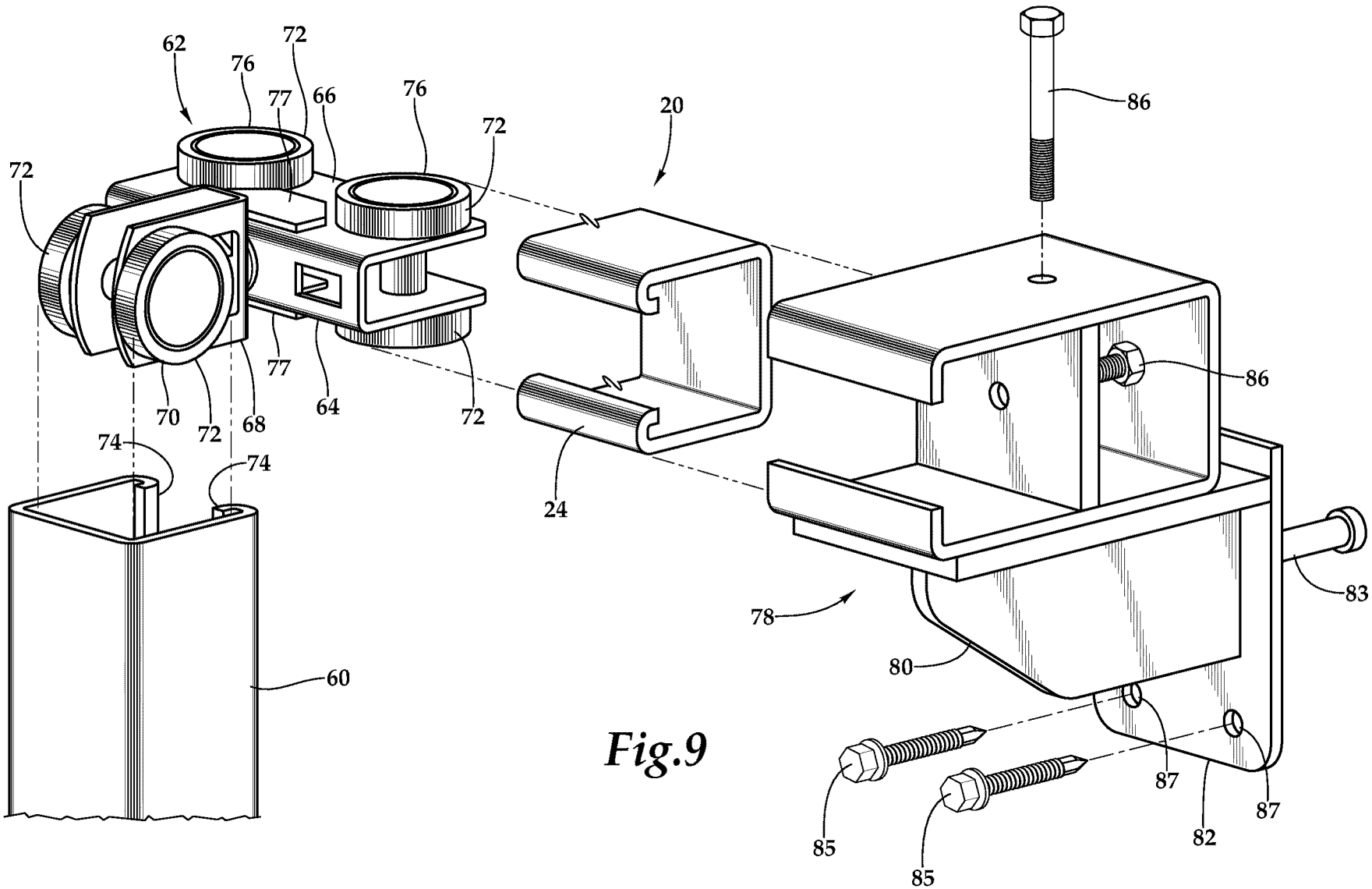
FIG. 9 is an exploded isometric view of the mounting between the first frame of the rolling access step assembly of FIG. 6.

As shown in FIG. 3, the first frame has two upwardly extending rack track mounting channels 60 which are spaced horizontally from one another on either side of the frame. As shown in FIG. 9, the rack track mounting channels 60 are C-shaped in section and open towards the rack track 24. A follower assembly 62 engages each mounting channel 60 to the rack track 24. Each follower assembly 62 has a base 64 formed of two connected U-channel steel members 66, 68 which are pivotally connected to one another. A first set 70 of two wheels 72 is mounted to the member 68 of the base 64 to rotate about a substantially horizontal axis. The first set of wheels extend within the mounting channel 60. The wheels are retained within the mounting channel 60 by the channel lips 74. Two second sets 76 of wheels 72 are mounted to the U-channel steel member 66 and extend within the rack track 24. The wheels of the second sets 76 rotate about a substantially vertical axis and are retained in the rack track 24 by channel lips 74. The U-channel 66 which mounts the second sets 76 of wheels have upper and lower plastic wear strips 77 which bear on the lips 74 of the rack track 24. The first set of wheels 70 of each follower assembly 62 is received within each rack track mounting channel 60 for free vertical movement. Because of this free vertical movement, the rack track 24 may be mounted at any desired height which is overlapped by the rack track mounting channels, accommodating a wide range of shelf spacing in the rack to which the device is mounted. Moreover, this mounting arrangement allows the first frame to move horizontally while accommodating inaccuracies in the placement of the rack track 24 which may cause it to not be precisely parallel to the support surface track 26.

Figure 8:
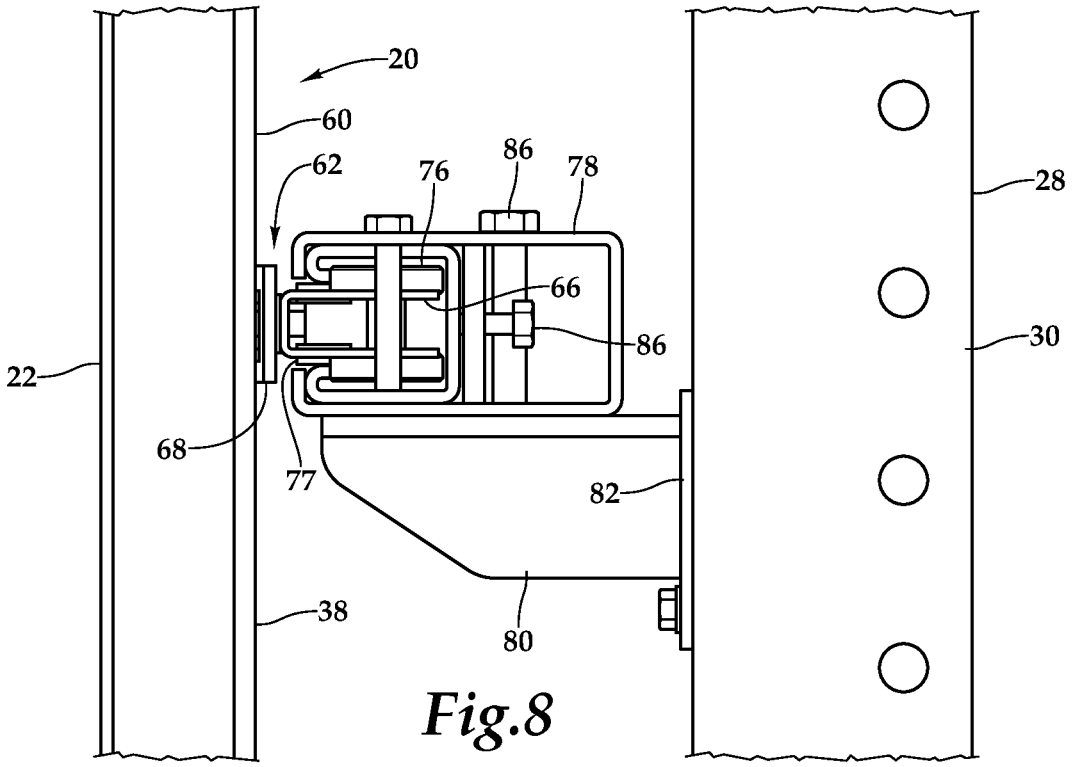
FIG. 8 is an enlarged side view of the rolling access step assembly of FIG. 6 taken at detail 8-8.

As shown in FIGS. 8 and 9, the rack track 24 is mounted to the vertical members 28 of the conventional rack 30 by a clamp 78. The clamp 78 has a web 80 which extends outwardly from a mounting plate 82 which may have pins 83 with heads which extend into the conventional teardrop shaped slots 84 (shown in FIG. 3) of the rack vertical member 28. The mounting plate 82 has lower holes 87 into which self-tapping hex head screws 85 may be inserted once the mounting plate in in position on a rack vertical member. The screws 85 protrude through slots 84 in the rack vertical member and restrain the bracket from moving upwardly. The clamp 78 has fasteners 86 which adjustably secure the clamp to the rack track 24. Multiple clamps 78 can be mounted to sequential vertical rack members, allowing for the attachment of one or more lengths of rack track 24 allowing the step structure 22 to travel any length of rack.

As shown in FIG. 1, the traveling step structure 22 second frame 39 is comprised of welded square tubular steel members including six vertical members 88. The second frame vertical members 88 extend upwardly from a bottom horizontal member 90. The second frame vertical members are spaced horizontally to align with the six first frame vertical members 40, however the heights of the second frame vertical members are not the same as the first frame vertical member heights. The outermost second frame vertical members 96 are not connected to an upper horizontal member. The two second frame vertical members 98 which are inward of the outermost members 96 extend to a top horizontal member 94, and are also connected by an intermediate horizontal member 92. The second frame innermost vertical members 100 also extend to the intermediate horizontal member 92.

As shown in FIG. 3, the second frame 39 is mounted to the first frame 38 by four lower steps 41 and one top step 104. As shown in FIG. 2, the steps are sheet metal having a central tread 106 with two downwardly extending flanges 108. For additional stiffness, the top step also has front and rear flanges. The side flanges of each step are connected by bolts 110 at one end to the first frame 38 between two vertical members 40 and are connected by bolts 110 at the other end to the second frame 39 between two vertical members 88. Plastic spacers 112 are preferably positioned on the bolts between the flange and the metal vertical member. Although not illustrated in the figures, a metal washer is preferably provided wherever a bolt head or nut touches the aluminum step. The steps are fastened to the vertical members to permit pivoting between the connected steps and the vertical members. The result is that the first frame 38 is connected to the second frame in a parallelogram type mechanism, allowing the second frame 39 to remain always parallel to the first frame 38 as it moves from a retracted position adjacent the first frame to an extended position spaced from the first frame. In the retracted position, as shown in FIG. 6, the step structure 22 does not block the corridor 34, and the treads 106 are sloped upwardly. In this configuration, the step structure may be engaged by a user and rolled along the width of the rack 30 to a desired location to access a particular item. In the extended position, as shown in FIG. 5, the treads 106 are substantially parallel to the support surface 32 and define three ascending and descending steps which may be readily mounted by a user with confidence, and may be descended by the user while carrying goods which have been retrieved from the rack.

Figure 5:
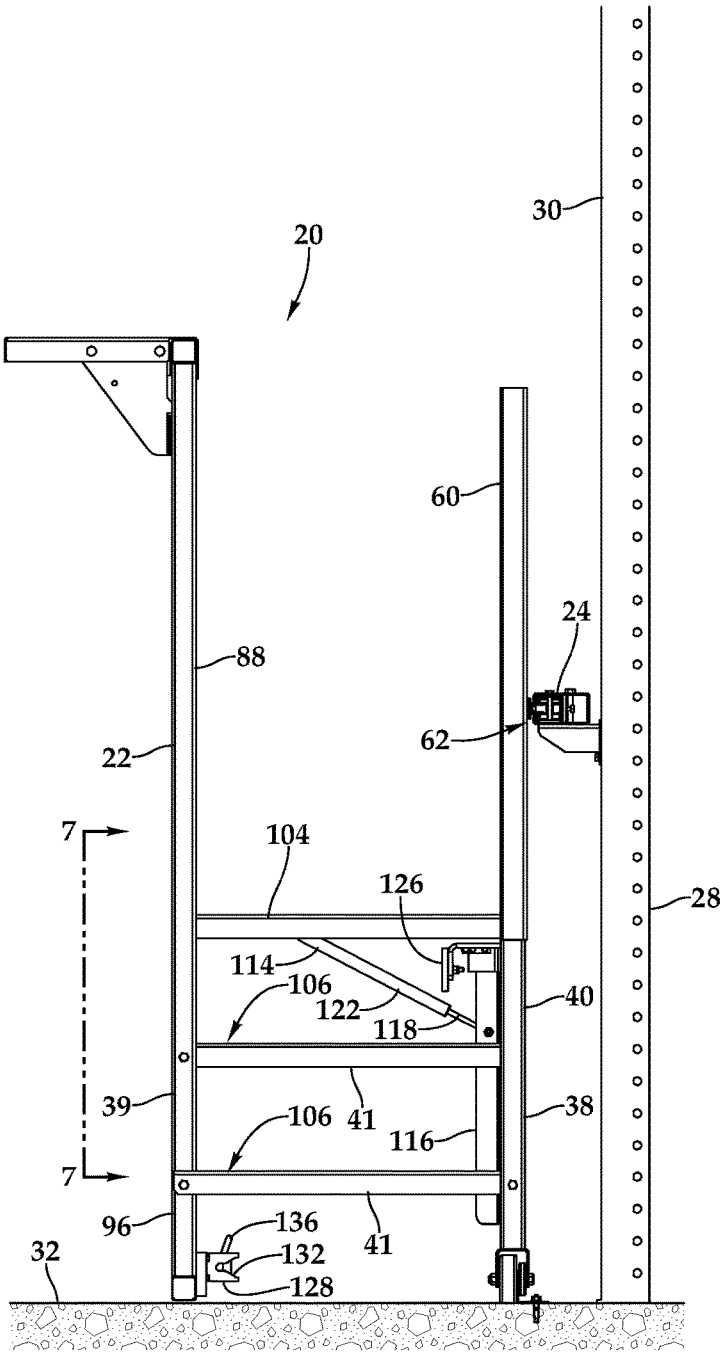
FIG. 5 is a side elevational view of the extended rolling access step assembly of FIG. 3.
Figure 6:
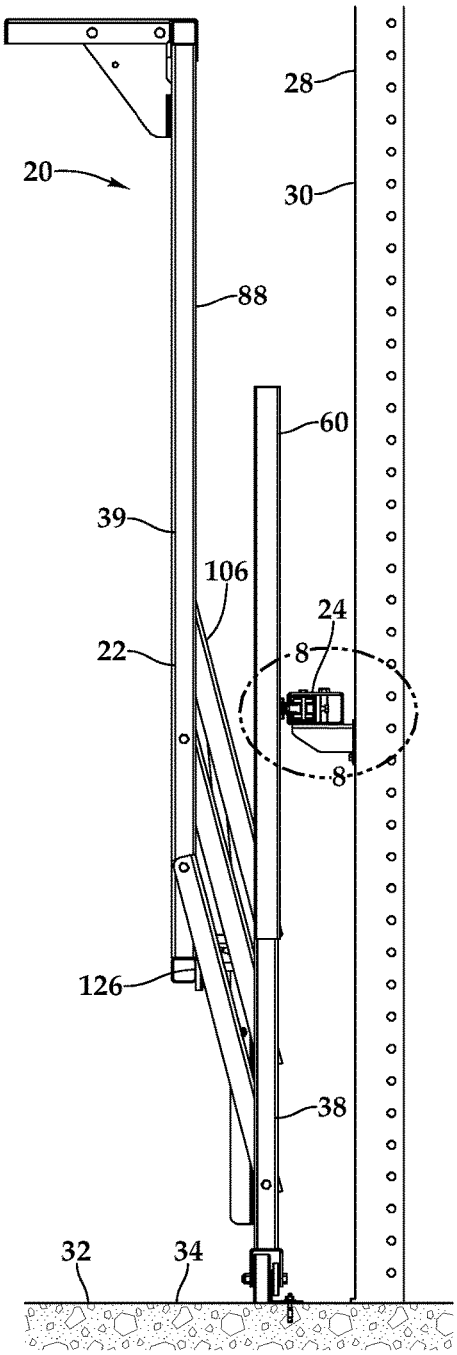
FIG. 6 is a side elevational view of the retracted rolling access step assembly of FIG. 1.

As shown in FIG. 5, to reduce the impact of the change in position of the second frame, to serve as a shock absorber, and to assist the user in returning the step structure to the retracted position, one or more damper assemblies 114 extend between the first frame 38 and a bracket 116 which projects downwardly from the top step. As shown in FIG. 7, the damper assembly 114 may be a conventional gas spring comprised of an extensible piston 118 which is pivotably mounted to a second bracket 120 which is fixed to the first frame and a cylinder housing 122 which is pivotably mounted to the bracket 116 beneath the top step. The spring strength of the damper assembly should be selected to be less than the total weight of the step structure such that the step structure will remain in the extended position when placed there by a user, but which will substantially reduce the force required by the user to return the step structure to its retracted configuration. Other mechanical spring arrangements may be used in place of a gas spring. As shown in FIG. 5, in the extended position the second frame need not touch the support surface until the user ascends the steps, thus reducing resistance to horizontal movement should the user wish to reposition the step structure in its extended position. Once the user mounts the steps, the bottom horizontal member 90 of the second frame will engage the support structure and resist any further horizontal movement. Because a series of steps is provided on either side of the top step, a user can access an elevated shelf by approaching the step structure from either side, thereby expediting the user travel along a required path. In addition, the user may descend along the path of ascension, or on the opposite side, depending on the user's destination, also reducing unnecessary steps.

As shown in FIG. 3, the top horizontal member 94 in the stair structure extended position serves as a railing which restrains the user on the elevated top step. In addition, the top horizontal member 94 may support a removable shelf 102, which enables a user to rest items retrieved from the rack on the shelf while obtaining additional items, before stacking all the items to carry them down the steps. The shelf 102 may have support struts 124 which extend downwardly and engage against the second frame vertical members 98. The shelf 102 may be releasably secured to the vertical members 98 by removable pins (not shown).

To maintain the step structure 22 in its retracted position, latching arrangements may be provided between the first frame 38 and the second frame 39. A magnetic latch 126, shown in FIGS. 5 and 7, may be fixed to the central cross member 46 of the first frame beneath the top step 104. In the retracted position, as shown in FIG. 6, the magnetic latch 126 engages the bottom horizontal member 90 of the second frame 39 and retains the second frame in the retracted position by magnetic attraction. In addition to the magnetic latch, or as an alternative thereto, a two-part mechanical latch assembly 128 may be provided. The latch assembly 128 may be similar to a conventional finger-release gate latch, and has a horizontal pin 130 which is mounted to the central cross member 46 of the first frame 42. The latch body 132 is mounted to the bottom horizontal member 90 of the second frame 39 and has a finger-operated release lever 136.

It is understood that the invention is not limited to the particular construction and arrangement of parts herein illustrated and described, but embraces all such modified forms thereof as come within the scope of the following claims.

We claim:

1. An accessible rack structure comprising:

a rack having a plurality of vertically extending members to which a plurality of elevated shelves are connected, the plurality of elevated shelves being vertically spaced from one another, wherein the rack is mounted to a horizontal support surface which supports the rack and which extends horizontally from the rack to define a corridor which extends along the rack from which goods stored on the plurality of elevated shelves of the rack may be accessed;

a rack track mounted between the vertical members of the rack;

a rolling access step assembly having a first frame which extends vertically and which has a plurality of follower assemblies which engage with the rack track, wherein a plurality of rollers are mounted to the first frame beneath the follower assemblies and which extend downwardly to engage the horizontal support surface, the first frame being thereby movable horizontally along a length of the rack;

the rolling access step assembly further having a second frame connected to the first frame by steps which are pivotably mounted at one end to the first frame, and at an opposite end to the second frame, the second frame is thus movable by pivoting of the steps from a retracted position in which the steps are inclined upwardly, in which the corridor is not blocked, and an extended position, in which the steps have portions which are substantially parallel to the support surface, the steps defining a plurality of steps extending from the corridor to a top step on either side of the top step, such that the top step is reachable from opposite directions along the corridor, the rolling access step assembly being positionable at different positions along the corridor with respect to the rack while offering access along the steps to the plurality of elevated shelves of the rack.

2. The accessible rack structure of claim 1 wherein the plurality of first frame rollers each comprise a wheel which engages and travels over the horizontal surface, and the wheel includes a groove which engages with an upwardly extending flange of a support track which is mountable in a fixed position on the horizontal surface substantially parallel to the first frame and the rack.

3. The collapsible step assembly of claim 1 wherein the first frame further comprises two upwardly extending rack track mounting members, and one of the follower assemblies is received within each rack track mounting member for vertical movement, and wherein each follower assembly engages with the horizontal rack track.

4. The collapsible step assembly of claim 3 wherein each upwardly extending rack mounting member comprises a C-channel which opens towards the rack, and each follower assembly comprises a plurality of rollers mounted to a follower base with portions which travel vertically within the C-channel.

5. The collapsible step assembly of claim 4 wherein the plurality of rollers of each follower assembly comprises:

a first set of wheels which are mounted to the follower base to rotate about a substantially horizontal axis, and which extend within one of the upwardly extending rack track mounting members; and a second set of wheels which are mounted to the follower base to rotate about a substantially vertical axis and which extend within the horizontal rack track.

6. The collapsible step assembly of claim 1 further comprising a damper assembly mounted between the first frame and one of the plurality of steps which defines a mounting step, wherein the damper assembly comprises:

a cylinder housing having a first end; and an extensible piston which is received within the cylinder housing and having a second end, wherein the first end of the cylinder is pivotably mounted to one of the first frame and the mounting step, and the second end of the piston is pivotably mounted to the other of the first frame and the mounting step.

7. The collapsible step assembly of claim 1 further comprising:

a latch mounted to the second frame and selectively engaged with portions mounted to the first frame to thereby secure the traveling step assembly in the retracted position.

8. The collapsible step assembly of claim 1 further comprising a magnet mounted to one of the first and the second frame to magnetically engage the other of the first and the second frame to thereby retain the traveling step structure in the retracted position.

9. A collapsible step assembly for mounting to a rack extending from a horizontal support surface, the collapsible step assembly comprising:

a first frame for mounting to the rack, wherein the first frame has two rack track mounting members which extend upwardly, each rack track mounting member comprising a channel which opens towards the rack;

a horizontal rack track for mounting to the rack at a position at which the first frame rack track mounting members overlap the rack track;

two follower assemblies, one follower assembly received within each of the two rack track mounting members for vertical movement, and each follower assembly having portions received within the rack track for motion horizontally with respect to the rack;

a plurality of steps pivotably mounted to the first frame;

a second frame pivotably mounted to the plurality of steps, wherein the first frame, steps, and second frame comprise a traveling step structure, the second frame being extendable on the steps from a retracted position to an extended position in which the spacing of the second frame from the first frame is greater than when in the retracted position, wherein in the extended position the plurality of steps are substantially horizontal for access by a user; and rollers mounted to and beneath the first frame to engage the horizontal support surface, the vertical movement of the follower assemblies allowing the first frame to move horizontally while accommodating inaccuracies in the placement of the rack track.

10. The collapsible step assembly of claim 9 further comprising a damper assembly which is pivotably mounted between the first frame and one of the plurality of steps which defines a mounting step, the damper assembly serving to cushion deployment of the traveling step structure from the retracted to the extended position.

11. The collapsible step assembly of claim 10 wherein the damper assembly comprises:

a cylinder housing having a first end; and an extensible piston which is received within the cylinder housing and having a second end, wherein the first end of the cylinder is pivotably mounted to one of the first frame and the mounting step, and the second end of the piston is pivotably mounted to the other of the first frame and the mounting step.

12. The collapsible step assembly of claim 9 wherein each follower assembly comprises:

a base;

a first set of wheels which are mounted to the base to rotate about a substantially horizontal axis, and which extend within one of the upwardly extending rack track mounting members; and a second set of wheels which are mounted to the base to rotate about a substantially vertical axis and which extend within the horizontal rack track.

13. The collapsible step assembly of claim 9 further comprising a plurality of horizontal rack track clamps which are adjustably secured to the horizontal rack track, each horizontal rack track clamp having a plurality of rearwardly protruding pins for extension into slots defined in a rack vertical member.

14. The collapsible step assembly of claim 9 further comprising:

a latch mounted to the second frame and selectively engaged with portions mounted to the first frame to thereby secure the traveling step assembly in the retracted position.

15. The collapsible step assembly of claim 9 further comprising a magnet mounted to one of the first and the second frame to magnetically engage the other of the first and the second frame to thereby retain the traveling step structure in the retracted position.

16. The collapsible step assembly of claim 9 further comprising a damper assembly which is pivotably mounted between the first frame and one of the plurality of steps, wherein the damper assembly cushions the movement of the second frame from the retracted position to the extended position.

17. An accessible rack structure comprising:

a plurality of vertically extending members which are fixed to a horizontal support surface;

at least one elevated shelf fixed to the plurality of vertically extending members for supporting goods thereon;

a horizontally extending rack track mounted to extend between the plurality of vertically extending members at a position spaced above the horizontal support surface;

a traveling step structure having a first frame mounted for horizontal movement to the horizontally extending rack track, the first frame having a plurality of spaced vertical members which extend between and are connected by an upper member;

the traveling step structure further having a second frame positioned outwardly from the first frame, the second frame having a plurality of upwardly extending vertical members, wherein the second frame is connected to the first frame by a plurality of steps including a lower step and an upper step positioned above the lower step, wherein the lower step is pivotably mounted at one end to two of the plurality of spaced vertical members of the first frame at a first elevation, and the upper step is mounted at one end to two of the plurality of spaced vertical members of the first frame at a second elevation which is spaced a first distance to be higher than the first elevation, and wherein the lower step is pivotably mounted at a second end to two of the plurality of spaced vertical members of the second frame, and the upper step is pivotably mounted at a second end to two of the plurality of spaced vertical members of the second frame, the first frame being thereby connected to the second frame by the plurality of steps in a parallelogram mechanism, allowing the second frame to remain always parallel to the first frame as it moves from a retracted position adjacent the first frame to an extended position spaced from the first frame, the plurality of steps being in a substantially horizontal position in the extended position to permit a user to mount the plurality of steps and access elevated shelves of the rack; and a damper assembly mounted between movable portions of the traveling step structure to cushion movement of the traveling step structure from the retracted to the extended position.

18. The accessible rack structure of claim 17 further comprising a support track which is fixed to the horizontal surface beneath the horizontally extending rack track, wherein the first frame is mounted for horizontal movement to the support track by a wheel having a peripheral groove which is rotatably mounted to a lower portion of the first frame, and wherein the support track has an upwardly extending flange which extends into the peripheral groove.

19. The accessible rack structure of claim 17 wherein the first frame is mounted to the horizontally extending rack track by two upwardly extending rack track mounting channels which are spaced horizontally from one another, and wherein a follower assembly is engaged with each of the two upwardly extending rack track mounting channels, and each follower assembly has portions which are received within one of the two upwardly extending rack track mounting channels for vertical movement, and wherein each follower assembly has portions which engage within the horizontally extending rack track for horizontal motion therein.

20. The accessible rack structure of claim 17 wherein the plurality of steps extending between the first frame and the second frame define three ascending and descending steps which are readily mounted by a user and which permit descent by the user while carrying goods which have been retrieved from the rack.

21. A collapsible step assembly for mounting to a rack extending from a horizontal support surface, the collapsible step assembly comprising:

a first frame for mounting to the rack, wherein the first frame has two rack track mounting members which extend upwardly, each rack track mounting member comprising a C-channel which opens towards the rack;

a follower assembly received within each rack track mounting member for vertical movement, wherein each follower assembly comprises a plurality of rollers mounted to a follower base with portions which travel vertically within the C-channel, each follower assembly plurality of rollers comprising a first set of wheels which are mounted to the follower base to rotate about a substantially horizontal axis, and which extend within one of the rack track mounting members, and a second set of wheels which are mounted to the follower base to rotate about a substantially vertical axis and which extend within a horizontal rack track for mounting to the rack, the first frame being thereby mountable to the rack for horizontal motion with respect to the rack;

a plurality of steps pivotably mounted to the first frame;

a second frame pivotably mounted to the plurality of steps, wherein the first frame, steps, and second frame comprise a traveling step structure;

a damper assembly which is pivotably mounted between the first frame and one of the plurality of steps, wherein the damper assembly cushions the movement of the second frame from a retracted position to an extended position in which the spacing of the second frame from the first frame is greater than when in the retracted position, wherein in the extended position the plurality of steps are substantially horizontal for access by a user; and rollers mounted to and beneath the first frame to engage the horizontal support surface.

* * * * *